US010597962B2

(12) United States Patent
Costa de Oliveira et al.

(10) Patent No.: US 10,597,962 B2
(45) Date of Patent: Mar. 24, 2020

(54) DRILLING WITH A WHIPSTOCK SYSTEM

(71) Applicant: Saudi Arabian Oil Company, Dhahran (SA)

(72) Inventors: Victor Carlos Costa de Oliveira, Dhahran (SA); Ossama Sehsah, Dhahran (SA); Mario Augusto Rivas Martinez, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 124 days.

(21) Appl. No.: 15/718,942

(22) Filed: Sep. 28, 2017

(65) Prior Publication Data

US 2019/0093436 A1 Mar. 28, 2019

(51) Int. Cl.

| | |
|---|---|
| ***E21B 7/08*** | (2006.01) |
| ***E21B 23/04*** | (2006.01) |
| ***E21B 23/01*** | (2006.01) |
| ***E21B 7/06*** | (2006.01) |
| ***E21B 47/12*** | (2012.01) |
| *E21B 29/06* | (2006.01) |

(52) U.S. Cl.

CPC ..... *E21B 23/04* (2013.01); *E21B 7/061* (2013.01); *E21B 23/01* (2013.01); *E21B 47/12* (2013.01); *E21B 29/06* (2013.01)

(58) Field of Classification Search

CPC ..... E21B 7/061; E21B 23/01; E21B 23/06

See application file for complete search history.

(56) References Cited

U.S. PATENT DOCUMENTS

| | | | |
|---|---|---|---|
| 1,812,044 | A | 6/1931 | Grant |
| 3,335,801 | A | 8/1967 | Wilsey |
| 3,557,875 | A | 1/1971 | Solum et al. |
| 4,058,163 | A | 11/1977 | Yandell |
| 4,384,625 | A | 5/1983 | Roper et al. |
| 4,399,873 | A | 8/1983 | Lindsey, Jr. |
| 4,458,761 | A | 7/1984 | Van Vreeswyk |

(Continued)

FOREIGN PATENT DOCUMENTS

| | | |
|---|---|---|
| CN | 204177988 | 2/2015 |
| EP | 377234 | 10/1989 |

(Continued)

OTHER PUBLICATIONS

Engineering Innovation Worldwide, TIW XPAK Liner Hanger System brochure, 2015 TIW Corporation, Houston TX , TIW0001D Jun. 2015, retrieved form the internet at: http://www.tiwoiltools.com/Images/Interior/downloads/tiw_xpak_brochure.pdf, 4 pages.

(Continued)

*Primary Examiner* — D. Andrews

(74) *Attorney, Agent, or Firm* — Fish & Richardson P.C.

(57) ABSTRACT

A whipstock system and methods are disclosed, including a whipstock body, a control unit mounted on or in the whipstock body, the control unit comprising transmitters and receivers operable to receive commands from an external source, activatable components mounted on or in the whipstock body, and a hydraulic system in the whipstock body, the hydraulic system in communication with the control unit, the hydraulic system including at last one hydraulic power unit operable to repeatedly activate and de-activate the activatable components.

21 Claims, 6 Drawing Sheets

(56) References Cited

U.S. PATENT DOCUMENTS 4,482,014 A 11/1984 Allwin et al.
4,646,842 A 3/1987 Arnold et al.
4,674,569 A 6/1987 Revils et al.
4,681,159 A 7/1987 Allwin et al.
4,693,328 A 9/1987 Furse et al.
4,852,654 A 8/1989 Buckner
4,855,820 A 8/1989 Barbour
4,944,348 A 7/1990 Whiteley et al.
4,993,493 A 2/1991 Arnold
5,152,342 A 10/1992 Rankin et al.
5,390,742 A 2/1995 Dines et al.
5,947,213 A 9/1999 Angle
6,009,948 A 1/2000 Flanders et al.
RE36,556 E 2/2000 Smith
6,152,221 A 11/2000 Carmicheal et al.
6,163,257 A 12/2000 Tracy
6,234,250 B1 5/2001 Green et al.
6,378,628 B1 4/2002 McGuire et al.
6,527,066 B1 3/2003 Rives
6,550,534 B2 4/2003 Brett
6,577,244 B1 6/2003 Clark et al.
6,662,110 B1 12/2003 Bargach et al.
6,684,953 B2 2/2004 Sonnier
6,691,779 B1 2/2004 Sezginer et al.
6,739,398 B1 5/2004 Yokley et al.
6,752,216 B2 6/2004 Coon
6,873,267 B1 3/2005 Tubel et al.
6,899,178 B2 5/2005 Tubel
6,938,698 B2 9/2005 Coronado
7,219,730 B2 5/2007 Tilton et al.
7,228,902 B2 6/2007 Oppelt
7,243,735 B2 7/2007 Koederitz et al.
7,252,152 B2 8/2007 LoGiudice et al.
7,278,492 B2 10/2007 Braddick
7,419,001 B2 9/2008 Broussard
7,581,440 B2 9/2009 Meek
7,654,334 B2 2/2010 Manson
7,665,537 B2 2/2010 Patel et al.
7,677,303 B2 3/2010 Coronado
7,938,192 B2 5/2011 Rytlewski
7,940,302 B2 5/2011 Mehrotra et al.
8,028,767 B2 10/2011 Radford et al.
8,102,238 B2 1/2012 Golander et al.
8,191,635 B2 6/2012 Buske et al.
8,237,585 B2 8/2012 Zimmerman
8,334,775 B2 12/2012 Tapp et al.
8,424,605 B1 4/2013 Schultz et al.
8,448,724 B2 5/2013 Buske et al.
8,469,084 B2 6/2013 Clark et al.
8,528,668 B2 9/2013 Rasheed
8,540,035 B2 9/2013 Xu et al.
8,750,513 B2 6/2014 Renkis
8,789,585 B2 7/2014 Leising et al.
8,800,655 B1 8/2014 Bailey
8,833,472 B2 9/2014 Hay
8,919,431 B2 12/2014 Lott
8,925,213 B2 1/2015 Sallwasser
8,991,489 B2 3/2015 Redlinger et al.
9,051,792 B2 6/2015 Herberg et al.
9,091,148 B2 7/2015 Moffitt et al.
9,121,255 B2 9/2015 Themig et al.
9,140,100 B2 9/2015 Daccord et al.
9,157,294 B2 10/2015 Kleppa et al.
9,187,959 B2 11/2015 Treviranus et al.
9,208,676 B2 12/2015 Fadell et al.
9,341,027 B2 5/2016 Radford et al.
9,494,003 B1 11/2016 Carr
9,506,318 B1 11/2016 Brunet
9,546,536 B2 1/2017 Schultz et al.
2002/0053434 A1 5/2002 Chen et al.
2002/0070018 A1* 6/2002 Buyaert ..... E21B 7/061 166/255.3
2002/0148607 A1 10/2002 Pabst
2003/0001753 A1 1/2003 Cernocky et al.
2004/0060741 A1 4/2004 Shipalesky et al.
2004/0069496 A1 4/2004 Hosie et al.
2004/0156264 A1 8/2004 Gardner et al.
2005/0273302 A1 12/2005 Huang et al.
2006/0081375 A1 4/2006 Ruttley
2006/0086497 A1 4/2006 Ohmer et al.
2006/0107061 A1 5/2006 Holovacs
2006/0260799 A1 11/2006 Broussard
2006/0290528 A1 12/2006 MacPherson et al.
2007/0057811 A1 3/2007 Mehta
2007/0107911 A1 5/2007 Miller et al.
2007/0187112 A1 8/2007 Eddison et al.
2007/0261855 A1 11/2007 Brunet
2008/0041631 A1 2/2008 Vail, III
2008/0115574 A1 5/2008 Meek
2009/0045974 A1 2/2009 Patel
2009/0050333 A1 2/2009 Smith
2009/0114448 A1 5/2009 Laird et al.
2009/0223670 A1 9/2009 Snider
2009/0289808 A1 11/2009 Prammer
2010/0097205 A1 4/2010 Script
2010/0101786 A1 4/2010 Lovell et al.
2010/0212891 A1 8/2010 Stewart et al.
2010/0212900 A1 8/2010 Eddison et al.
2010/0212901 A1 8/2010 Buytaert
2010/0258298 A1 10/2010 Lynde et al.
2010/0282511 A1 11/2010 Maranuk et al.
2011/0067884 A1 3/2011 Burleson et al.
2011/0073329 A1 3/2011 Clemens et al.
2011/0127044 A1 6/2011 Radford et al.
2011/0147014 A1 6/2011 Chen et al.
2011/0240302 A1 10/2011 Coludrovich, III
2011/0266004 A1 11/2011 Hallundbaek et al.
2012/0085540 A1 4/2012 Heijnen
2012/0175135 A1 7/2012 Dyer et al.
2012/0241154 A1 9/2012 Zhou
2012/0247767 A1 10/2012 Themig et al.
2012/0307051 A1 12/2012 Welter
2012/0312560 A1 12/2012 Bahr et al.
2013/0128697 A1 5/2013 Contant
2013/0153245 A1 6/2013 Knobloch et al.
2013/0299160 A1* 11/2013 Lott ..... E21B 23/01 166/88.2
2014/0060844 A1 3/2014 Barbour et al.
2014/0083769 A1 3/2014 Moriarty et al.
2014/0090898 A1 4/2014 Moriarty et al.
2014/0126330 A1 5/2014 Shampine et al.
2014/0131036 A1 5/2014 Huval et al.
2014/0139681 A1 5/2014 Jones, Jr. et al.
2014/0166367 A1 6/2014 Campbell et al.
2014/0172306 A1 6/2014 Brannigan
2014/0208847 A1 7/2014 Baranov
2014/0308203 A1 10/2014 Sheinberg et al.
2015/0027706 A1 1/2015 Symms
2015/0090459 A1 4/2015 Cain et al.
2015/0101863 A1* 4/2015 Jeffryes ..... E21B 7/061 175/24
2015/0152713 A1 6/2015 Garcia et al.
2015/0176362 A1 6/2015 Prieto et al.
2015/0267500 A1 9/2015 Van Dongen et al.
2015/0308203 A1 10/2015 Lewis
2016/0160578 A1 6/2016 Lee
2016/0215612 A1 7/2016 Morrow
2016/0230508 A1 8/2016 Jensen
2016/0237764 A1 8/2016 Jellison et al.
2016/0237768 A1 8/2016 Jamison et al.
2016/0356152 A1 12/2016 Croux
2017/0074071 A1 3/2017 Tzallas et al.
2018/0030810 A1 2/2018 Saldanha

FOREIGN PATENT DOCUMENTS

EP 618345 10/1994
EP 1241321 9/2002
EP 2692982 5/2014
EP 2835493 2/2015
GB 2157743 10/1985
GB 2261238 12/1993
GB 2460096 11/2009
GB 2470762 12/2010

(56) References Cited

FOREIGN PATENT DOCUMENTS

| | | |
|---|---|---|
| WO | 2003058545 | 7/2003 |
| WO | 2011038170 | 3/2011 |
| WO | 2011095600 | 8/2011 |
| WO | 2011159890 | 12/2011 |

OTHER PUBLICATIONS

Engineers Edge—ACME Stub Threads Size Designation Table Chart, retrieved from the internet at: http://www.engineersedge.com/hardware/acme-stub-thread.htm, retrieved Feb. 27, 2017, 2 pages.

Mi Swaco: A Schlumberger Company, "Intelligent Fluids Monitoring System," available on or before Mar. 11, 2015, [retrieved May 1, 2018] retrieved from URL: <https://www.slb.com/resources/other_resources/brochures/miswaco/intelligent_fluids_monitoring_brochure.aspx>, 8 pages.

Offshore, "Completions Technology: Large monobore completions prevent high-volume gas well flow restrictions", Dec. 1, 2001, retrieved from the internet: • http://www.offshore-mag.com/articles/print/volume-61/issue-12/news/completions-technology-large-monobore-completions-prevent-high-volume-gas-well-flow-restrictions.html, 9 pages.

International Search Report and Written Opinion issued in International Application No. PCT/US2018/052564 dated Jan. 4, 2019, 14 pages.

* cited by examiner

DRILLING WITH A WHIPSTOCK SYSTEM

TECHNICAL FIELD

This invention relates to a whipstock system, for example, to perform a whipstock installation within a wellbore.

BACKGROUND

Wellbores can be drilled into geologic formations for a variety of reasons, such as, for example, hydrocarbon production, fluid injection, or water production. In the oil and gas industry, a whipstock can be used for sidetracking an initial wellbore or in preparation for directional or horizontal drilling. This process is carried out, for example, to direct a drill string into a new formation, to avoid abandoned objects downhole, or to perform a casing milling operation to cut into the casing around an existing wellbore.

SUMMARY

This disclosure describes tools and methods relating to drilling with whipstock tools that include an independent hydraulic system controlled wirelessly from the surface and/or from a measurement while drilling (MWD) sub assembly. The whipstock tool has independent hydraulic power units that can activate and de-activate tool components such as, for example, upper slips, fluid-isolating rubber elements, and lower slips multiple times. Transmitters and receivers are located at a control unit part of the whipstock tool. In some applications, these transmitters and receivers provide real-time communication between the whipstock tool and the surface, delivering, for example, information regarding the functioning of the whipstock to the surface and commands to the whipstock tool.

Use of an independent hydraulic system controlled wirelessly from the surface or from a MWD sub eliminates the need for a hydraulic control line from the milling assembly to the whipstock tool. This approach increases the robustness of the whipstock system by eliminating the possibility of failure due to damage to the control line while running in hole. The whipstock assembly allows drilling and completion engineers to monitor the functionality of the system and evaluate the mechanisms in real time, identifying premature failures and reducing the costs of the operation.

A whipstock system includes a whipstock body, a control unit mounted on or in the whipstock body, the control unit comprising transmitters and receivers operable to receive commands from an external source, activatable components mounted on or in the whipstock body, and a hydraulic system in the whipstock body, the hydraulic system in communication with the control unit, the hydraulic system including at last one hydraulic power unit operable to repeatedly activate and de-activate the activatable components.

In some implementations, the activatable components include at least one slips assembly and at least one seal assembly. The activatable components include an upper slips assembly and a lower slips assembly. The hydraulic system includes a reservoir and an expansion chamber in the whipstock body, and a pump in the whipstock body in fluid communication with the reservoir and the expansion chamber, wherein transfer of fluid from the reservoir to the expansion chamber activates at least one of the activatable components. The control unit includes one or more processors, and a computer-readable medium storing instructions executable by the one or more processors to perform operations comprising receiving, from the external source, instructions to perform whipstock operations within the wellbore, and transmitting, to the hydraulic system, at least a portion of the instructions. The hydraulic power unit is operatively coupled to the one or more processors and the hydraulic power unit configured to receive at least the portion of the instructions from the one or more processors. The pump is hydraulically connected to an upper slips assembly or a lower slips assembly.

In some implementations, the whipstock system has a mandrel movable to engage an anchor portion of the upper slips assembly or lower slips assembly. The hydraulic pump is hydraulically connected to the at least one seal assembly. The operations further include receiving, from the whipstock assembly, status signals representing a whipstock status of the at least one of the plurality of whipstock assembly, and transmitting, to the surface of the wellbore, the status signals. The external source includes one or more transmitters at the surface, the one or more transmitters configured to transmit the instructions to the one or more processors, and one or more receivers at the surface, the one or more receivers configured to receive the status signals from the one or more processors. The one or more transmitters and the one or more receivers are configured to communicate wirelessly with the one or more processors. The control assembly further includes a power source mounted on or in the whipstock body, the power source electrically coupled to the one or more processors. The power source is a wireless, stand-alone power source. The wireless, stand-alone power source is a lithium battery. The hydraulic system includes a check valve.

In some aspects a method of deploying a whipstock in a wellbore includes receiving, by a control assembly deployed within a wellbore, instructions to perform whipstock operations within the wellbore, transmitting, by the control unit, at least a portion of the instructions to a hydraulic system on a whipstock assembly, and activating at least one independent hydraulic power unit of the hydraulic system in response to the portion of the instructions transmitted by the control unit to activate components of the whipstock assembly. Activating at least one independent hydraulic power unit of the hydraulic system to activate components of the whipstock assembly includes activating at least one independent hydraulic power unit of the hydraulic system to activate a slips assembly or a seal assembly of the whipstock assembly. Activating at least one independent hydraulic power unit of the hydraulic system in response to the portion of the instructions transmitted by the control unit to deactivate components of the whipstock assembly. Activating at least one independent hydraulic power unit of the hydraulic system includes pumping fluid from a reservoir in the whipstock assembly to an expansion chamber of the whipstock assembly.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference numbers and designations in the various drawings indicate like elements.

DETAILED DESCRIPTION

This disclosure describes tools and methods relating to drilling with whipstock tools that include an independent hydraulic system controlled wirelessly from the surface and/or from a MWD sub assembly. The whipstock tool has independent hydraulic power units that can activate and de-activate tool components such as, for example, upper slips, fluid-isolating rubber elements, and lower slips multiple times. Transmitters and receivers are located at a control unit part of the whipstock tool. In some applications, these transmitters and receivers provide real-time communication between the whipstock tool and the surface delivering, for example, information regarding the functioning of the whipstock to the surface and commands to the whipstock tool.

Use of an independent hydraulic system controlled wirelessly from the surface or from a MWD sub eliminates the need for a hydraulic control line from the milling assembly to the whipstock tool. This approach increases the robustness of the whipstock system by eliminating the possibility of failure due to damage to the control line while running in hole. The whipstock assembly allows drilling and completion engineers to monitor the functionality of the system and evaluate the mechanisms in real time, identifying premature failures and reducing the costs of the operation.

Figure 1:
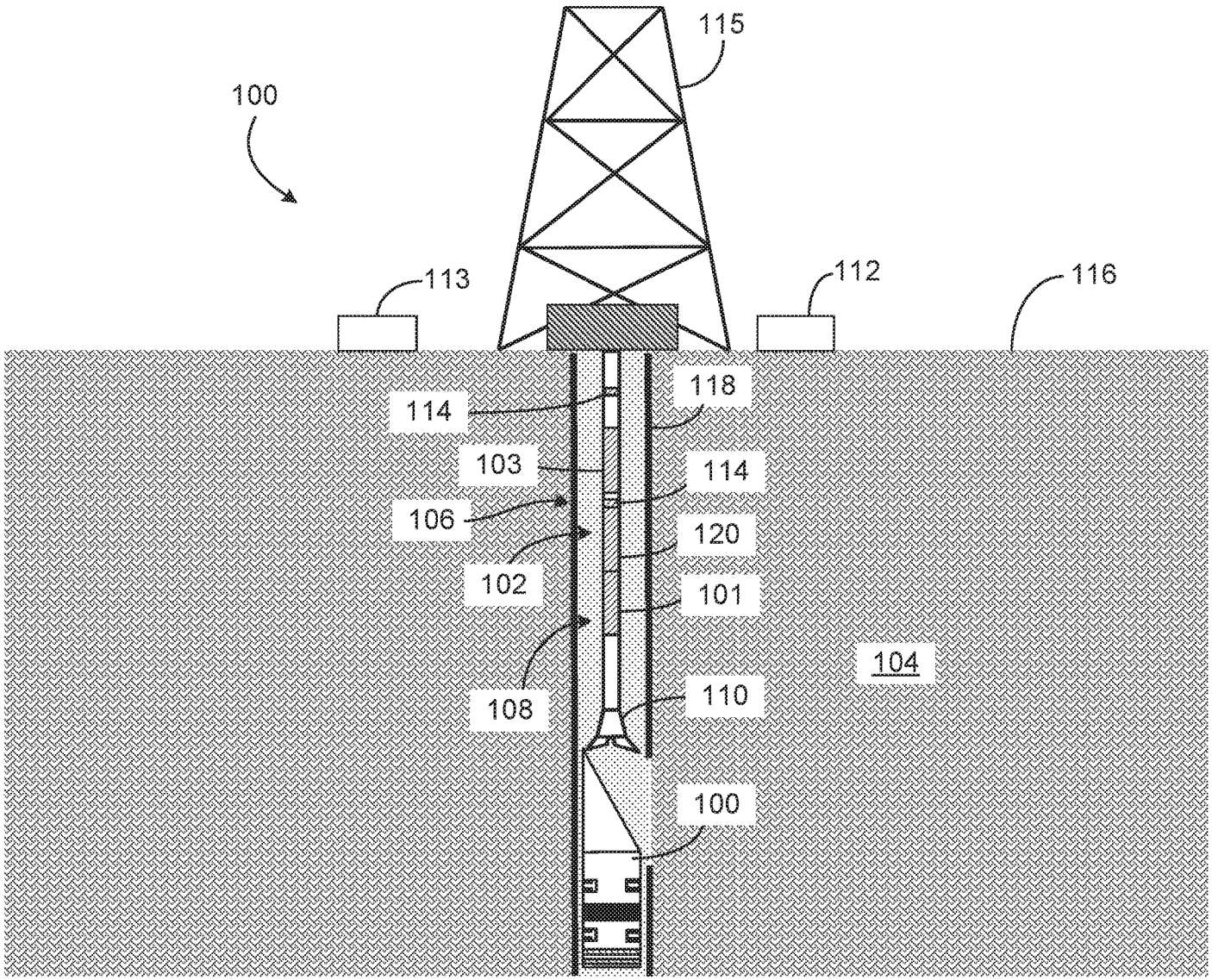
FIG. 1 is a schematic diagram of a wellbore drilling system.

FIG. 1 shows an example wellbore drilling system 100 being used in a wellbore 106. The well drilling system 100 includes a drill derrick 115 that supports the weight of and selectively positions a drill string 108 in the wellbore 106. The drill string 108 has a downhole end connected to a mill 110 that is used to extend the wellbore 106 in the formation 104. Once drilled, the wellbore 106 is provided with a casing 118 that provides additional strength and support to the wellbore 106. The wellbore drilling system 100 can include a bottom hole assembly (BHA) 102. The BHA 102 includes a MWD sub 120. The BHA 102 also includes a control assembly 101 mounted on and carried by the BHA 102. The control assembly 101 is designed to be deployed in the wellbore 106 and is configured to handle shock-loads, corrosive chemicals, or other potential downhole hazards.

To sidetrack from the wellbore 106, the drill string 108 and BHA 102 are withdrawn from the wellbore 106. A whipstock 200 is deployed into the wellbore 106 and prepared for operation as is described in more detail with respect to FIGS. 2-6. The drill string 108 and BHA 102 are deployed back down the wellbore 106 to the position of the whipstock 200. Contact with the whipstock 200 deflects the milling or boring direction of the mill 110 from its orientation in the previously drilled wellbore 106 toward a selected different direction.

The wellbore drilling system 100 includes one or more transmitters 112 at the surface 116. The one or more transmitters 112 can transmit whipstock operation instructions to the control assembly 101 or directly to the whipstock 200. In addition to the transmitters 112, one or more receivers 113 are positioned at the surface 116. The one or more receivers 113 are operable to receive one or more status signals from the control assembly 101. Each of the one or more transmitters 112 and the one or more receivers 113 communicate (for example, wirelessly) with the control assembly 101. In some implementations, the wireless communication include radio frequency communication, such as Wi-Fi. In some implementations, the wellbore drilling system 100 includes control wires providing communications with the control assembly 101 and the control assembly 101 includes a transmitter operable to communicate with the whipstock tool 200. In some implementations, the wellbore drilling system 100 includes one or more repeaters 114 positioned between the surface 116 and the BHA 102 within the wellbore 106. The repeaters 114 can boost a strength of a wireless signal between the one or more transmitters 112 or the one or more receivers 113 and the control assembly 101.

The wellbore drilling system 100 can be used in forming vertical, deviated, and horizontal wellbores. In some implementations, the wellbore drilling system 100 includes a sub 103 operable to receive status signals of the BHA 102 and transmit instructions to the BHA 102. In such an implementation, data received from the BHA 102 can be stored in the sub 103 and can be retrieved after the sub is returned to the topside facility.

Figure 2:
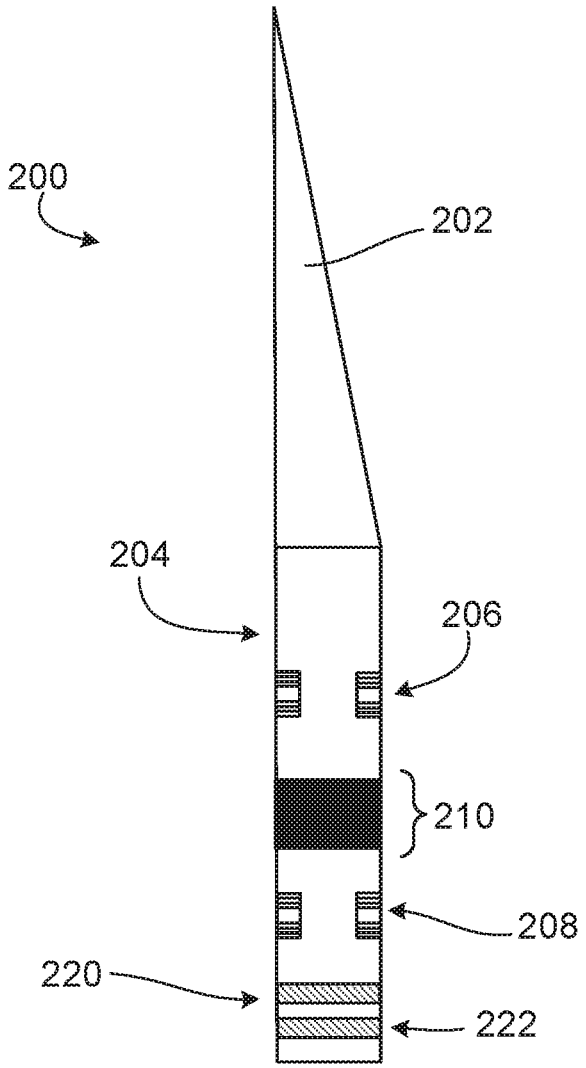
FIG. 2 is a side view of a whipstock assembly for use in a wellbore drilling system.

FIG. 2 shows a whipstock tool 200 that includes a whipstock ramp 202 positioned upward from a whipstock sub body 204. The whipstock tool 200 includes independent hydraulic power units 310, 312, 314 (depicted in FIG. 3) that can activate and de-activate tool components such as, for example, upper slips 206, seals 210, and lower slips 208 multiple times. Some whipstock tools include additional or alternative deployable components. The whipstock tool 200 also includes a control unit 220 and a battery 222. The control unit 220 includes one or more transmitters and receivers. In some applications, these transmitters and receivers provide real-time communication between the whipstock tool and the surface delivering, for example, information regarding the functioning of the whipstock to the surface and commands to the whipstock tool.

The whipstock tool 200 can be used in a method of providing directional drilling from a wellbore 106 that has been already drilled and, in some instances, cased. The whipstock ramp 202 includes a tapered steel guide for the drill string whose function is to deflect the milling or boring direction of the mill 110 from its orientation in a previously drilled wellbore, toward a selected different direction. The guide taper or ramp 202 provides a whipstock deflection surface that turns the borehole axis from alignment with the existing borehole to a deflected orientation (for example, the deflected orientation can be about 1° to about 10° relative to the axis of the main wellbore).

The whipstock sub body 204 is secured within an existing borehole casing 118 or wellbore 106 by slips or anchors 206, 208 located along the whipstock length below the bottom end of the deflection surface. The slips 206, 208 are firmly anchored to oppose the forces on the whipstock tool 200 along the existing borehole axis and the torque force imposed by the deflected drill string rotation.

The seals 210 engage sides of the existing borehole 106 below the whipstock sub body 204 and limit fluid communication between the lower portion of the existing wellbore and the new, deflected borehole.

The whipstock tool 200 deflects the bit cutting direction within the casing, which turns the mill 110 into the wall of the casing 118. After the whipstock sub body 204 is set, a window is milled into the wall of the casing 118 to provide a guide for the mill 110 to cut into the earth along the new, deflected direction. The window is milled by a steel milling tool with a milling bit at the end of the drill string 108. In some instances, one or more hole reaming tools can follow to enlarge the casing window.

The MWD sub 120 (see FIG. 1) reports downhole characteristics of the drilling operation (for example, location and orientation of the downhole components) to a surface receiver 113. When the face of the whipstock deflection surface ramp 202 is directionally oriented, the slips 206, 208 are engaged by fluid pressure.

Use of an independent hydraulic system controlled wirelessly from the surface or from a MWD sub eliminates the need for a hydraulic control line from the milling assembly to the whipstock tool. This approach increases the robustness of the whipstock system by eliminating the possibility of failure due to damage to the control line while running in hole and removing the need tubing and valves associated with the control line that are vulnerable to malfunction and in-running damage. In addition, the whipstock assembly allows drilling and completion engineers to monitor the functionality of the system and evaluate the mechanisms in real time, identifying premature failures and reducing the costs of the operation.

Figure 3:
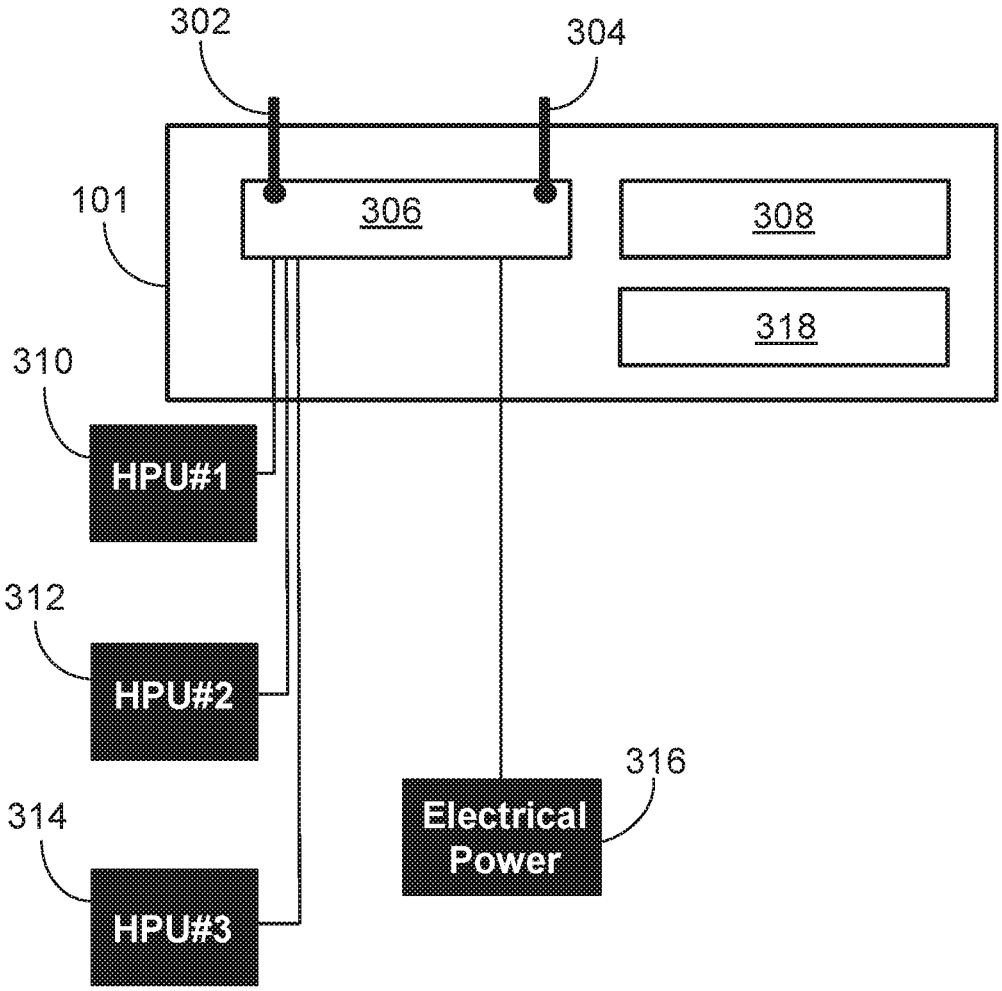
FIG. 3 shows a block diagram of an example control system of the whipstock assembly of FIG. 2.

FIG. 3 shows a block diagram of a control assembly 220 for controlling the whipstock tool 200. The control assembly 220 includes one or more processors 306 and a computer-readable medium 318 storing instructions executable by the one or more processors 306 to perform operations. The control assembly 220 also includes a transmitter 302 and receiver 304 that can be used to receive, from the surface 116, instructions to perform whipstock operations within the wellbore, and transmit at least a portion of the instructions to components such as, for example, the upper slips 206, lower slips 208, and/or rubber seals 210 of the whipstock tool 200. The receiver 304 also receives status signals representing a status of the whipstock tool 200. The transmitter 302 can also transmit the status signals to the surface 116. The status signals can include a state of a whipstock assembly (such as an "on" state or an "off" state), a hydraulic pressure of hydraulic power units of the whipstock tool 200, or the status of other components of the assembly. In some implementations, each of the upper slips 206, lower slips 208, and rubber seals 210 can communicate with the control tool, for example, through a control wires, wirelessly, or hydraulically.

The whipstock 200 includes the control unit 220 as a component of the whipstock. In some systems, the control unit is part of the BHA 102.

Control assemblies include a power source 308 is operatively coupled to the one or more processors 306 and can provide operating power to the one or more processors 306. In the whipstock 200, the power source 308 is the battery 222 (for example, a lithium ion battery).

The whipstock tool 200 includes at least one hydraulic power unit. For example, the whipstock 200 of the wellbore drilling system 100 includes as a first hydraulic power unit 310, a second hydraulic power unit 312, and a third hydraulic power unit 314, operatively coupled to the one or more processors 306 of the control unit 220. The hydraulic power units can receive at least a portion of a set of instructions from the one or more processors 306. The hydraulic power units may receive instructions to change states ("on" command or "off" command) of the hydraulic pump, set a target pressure for the hydraulic pump, or any other command that can be executed by the hydraulic power unit. In some implementations, the different hydraulic power units are interconnected to allow fluidic communication between each hydraulic power unit. The interconnection can allow a hydraulic power unit to control multiple whipstock subparts such as the upper slips 206, lower slips 208, and rubber seals 210 in the event of the failure of a hydraulic power unit. In some implementations, each of the whipstock tools include a separate control tool to facilitate communications with the control assembly 220. The one or more processors 306 are coupled to an electrical power source 316 that sends electrical power to the whipstock tool 200.

Figure 4B:
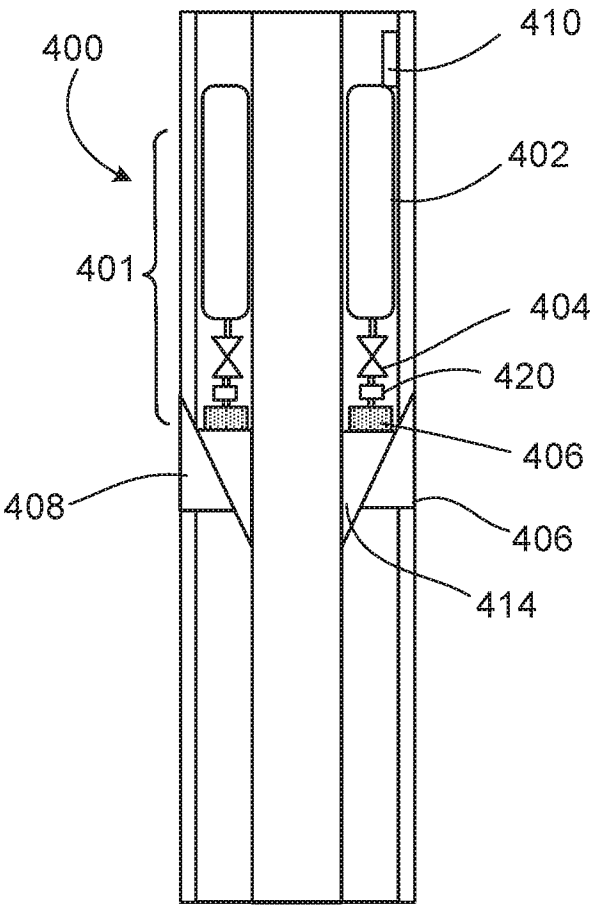
FIG. 4B is a schematic side view of a portion of the example whipstock assembly with anchors or slips activated.
Figure 4A:
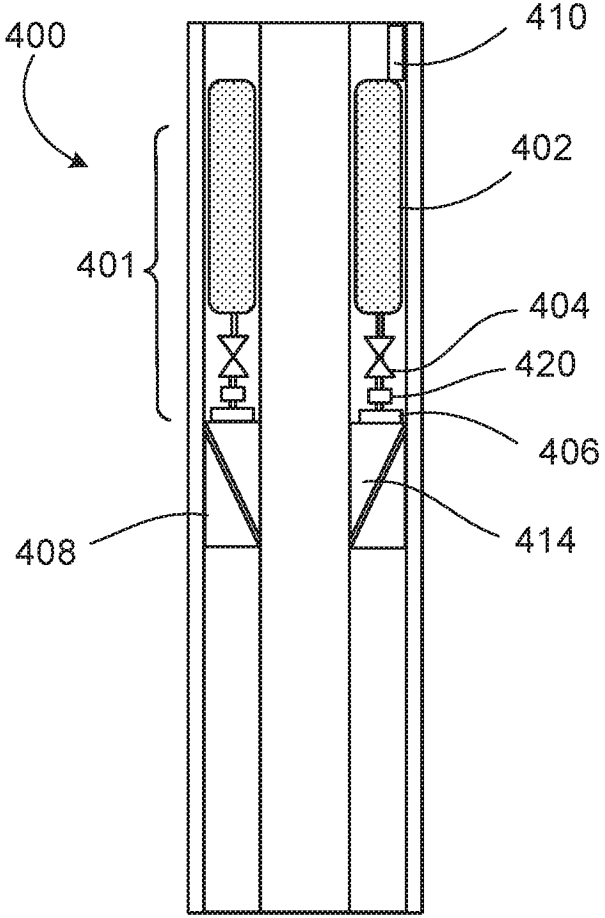
FIG. 4A is a schematic side view of a portion of an example whipstock assembly with anchors or slips deactivated.

FIGS. 4A-4B show a portion of an example whipstock tool 400 in various stages of operation. In FIG. 4A, slips 408 of the whipstock tool 400 are in a deactivated mode, while in FIG. 4B, the slips 408 of the whipstock tool 400 are in an activated mode. The slip assembly 400 includes a hydraulic power unit 401 operatively coupled to the control assembly 220 (for example, the first hydraulic power unit 310 or third hydraulic power unit 314 described with respect to FIG. 3). The hydraulic power unit 401 can act as the activation and deactivation unit for the upper slips 206 or lower slips 208.

The hydraulic power unit 401 can receive instructions from the control assembly 220. The instructions can include, for example, changing states of a hydraulic pump 404, changing an output pressure of the hydraulic pump 404, changing position of an actuatable tool such as the slips 408, or other commands that can be executed by the hydraulic power unit. The slips 408 are operatively coupled to the hydraulic power unit 401 such that the hydraulic power unit 401 can mechanically activate the tool to begin an anchoring operation within the wellbore 106 responsive to being activated. The anchors 408 can correspond to either of the upper slips 206 or lower slips 208.

The hydraulic power unit 401 includes a reservoir 402 and a hydraulic pump 404 fluidly connected to the reservoir 402 and the anchors 408. The hydraulic pump 404 can apply hydraulic fluid from reservoir 402, at a pressure sufficient to activate the slip assembly 400. Application of the hydraulic fluid to the slip assembly 400 causes the anchors 408 to extend radially outward from the slip assembly 400 and towards the wall of the wellbore 106. The slip assembly 400 includes sensors 410 to relay information back to the control assembly 220, such as hydraulic pressure or anchor 408 position.

Once the hydraulic power unit 401 has received a signal to activate the slip assembly 400, the hydraulic pump 404 moves hydraulic fluid from the hydraulic reservoir 402 to an expansion member 406. The expansion member 406 begins to expand. Expansion of the expansion member 406 moves a wedged mandrel 414 towards the anchors 408. The wedge shaped mandrel 414 causes the anchors 408 to extend radially outward from the slip assembly 400 and towards the wall of the wellbore 106.

The hydraulic pump 404 includes a check-valve 420 that prevents back-flow from the expansion member 406 to the hydraulic reservoir 402. In some implementations, the hydraulic power unit 401 includes one or more pressure sensors to measure a pressure of the hydraulic fluid. The pressure value detected by the one or more pressure sensors can be sent to the controller assembly 101, and the controller assembly 101 then transmits the pressure value to the surface 116. Once whipstock operations are completed, the control assembly 220 sends a signal to the hydraulic pump 404 to pump hydraulic fluid from the expansion member back into the hydraulic fluid reservoir. In some embodiments, the slip assembly 400 includes a retraction device, such as a spring 412, to return the mandrel 408 and anchors 408 back into the retracted position once the hydraulic fluid has been removed from the expansion member 406. The expansion member 406 can include, for example, a bladder, a piston, or any other expandable actuation device. In some implementations, the hydraulic power unit 401 may be fluidly connected to a separate hydraulic power unit in another portion of the whipstock assembly. Such a connection allows a single hydraulic power unit to control multiple components of the whipstock assembly in the event of a failure of one of the hydraulic power units.

Figure 5B:
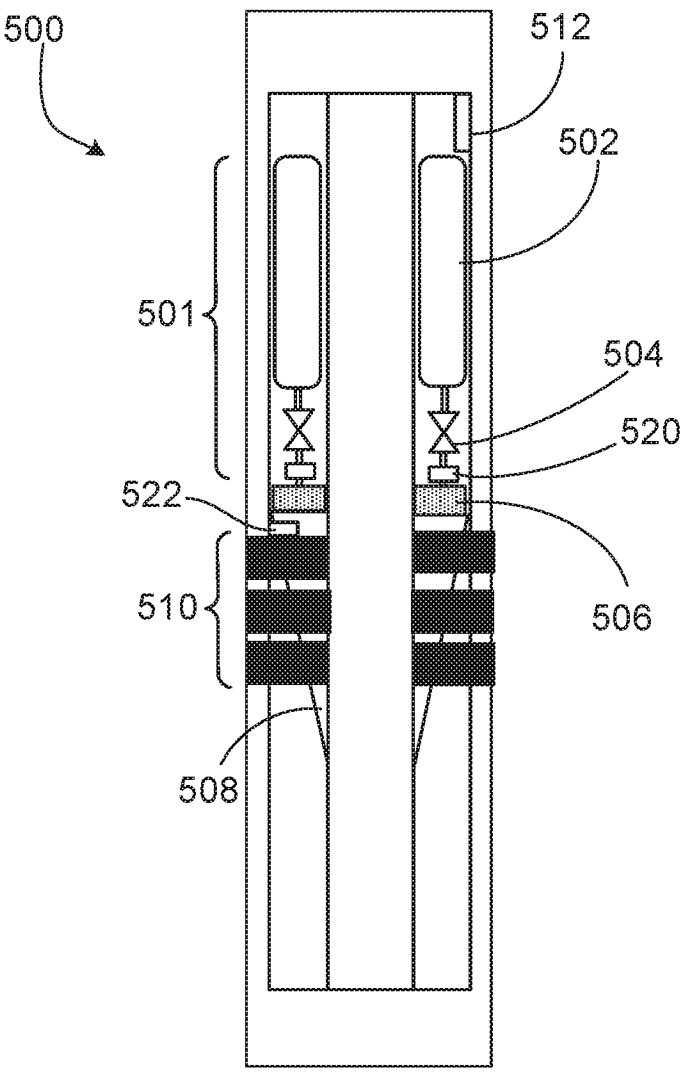
FIG. 5B is a schematic side view of a portion of an example whipstock assembly with rubber seals activated.
Figure 5A:
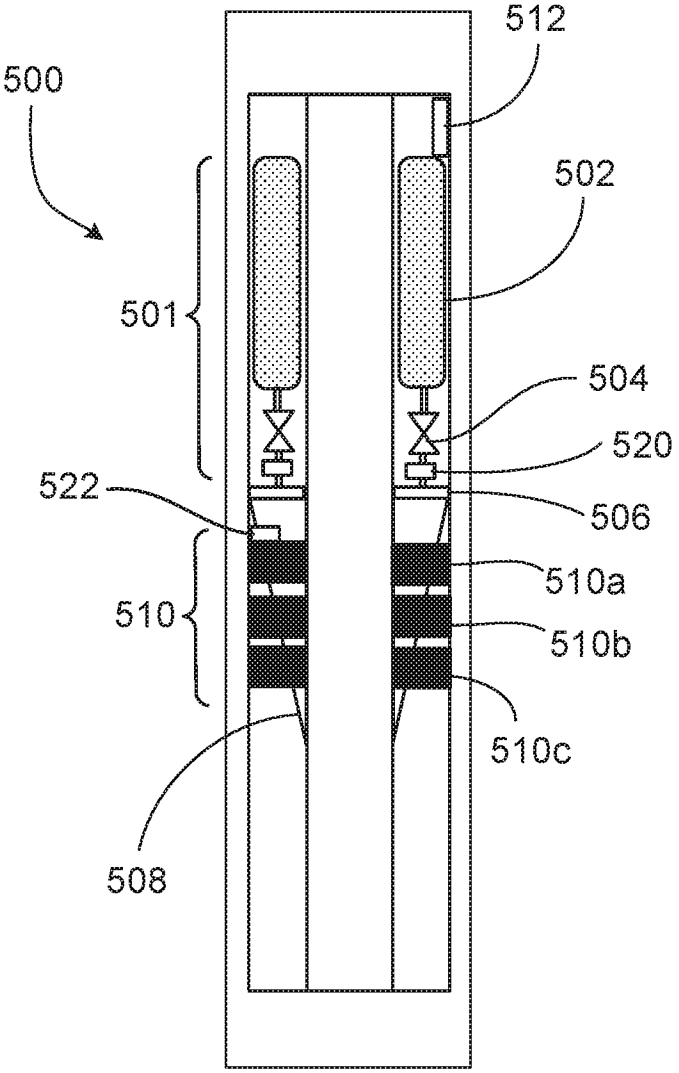
FIG. 5A is a schematic side view of a portion of an example whipstock assembly with rubber seals deactivated.

FIGS. 5A-5B show a rubber seal assembly 510 of a whipstock tool 500 in various stages of operation. In FIG. 5A, rubber elements 510*a*, 510*b*, 510*c* of seal 510 in the seal assembly 510 are in a deactivated mode, while in FIG. 5B, rubber elements 510*a*, 510*b*, 510*c* are in an activated mode. The whipstock tool 500 includes a hydraulic power unit 501 operatively coupled to the control assembly 220 (for example, the second hydraulic power unit 312 described with respect of FIG. 3) and that has a check valve 520. The hydraulic power unit 501 receives instructions from the control assembly 220. The whipstock instructions can include changing states of the hydraulic pump 504, changing an output pressure of the hydraulic pump 504, changing position of an actuatable tool such as rubber seal assembly 510 or other commands that can be executed by the hydraulic power unit. The tool is operatively coupled to the hydraulic power unit 501, that is, the hydraulic power unit 501 mechanically activates the rubber elements 510*a*, 510*b*, 510*c* to engage the casing 118 within the wellbore 106 to provide a fluid seal. For example, the hydraulic power unit 501 may cause the individual rubber elements 510*a*, 510*b*, 510*c* of seal assembly 510 to extend radially outward from the rubber element assembly 500 and towards the wall of the wellbore 106. In some implementations, the whipstock 500 includes sensors 512 to relay back information to the control assembly 220, such as hydraulic pressure or position of position of the rubber elements.

Once the hydraulic power unit 501 has received a signal to activate the seal assembly 510, the hydraulic pump 504 moves hydraulic fluid from a hydraulic reservoir 502 to an expansion member 506 to activate the seal assembly 510. The expansion member 506 moves a wedged mandrel 508 towards the rubber elements 510*a*, 510*b*, 510*c*. The wedge shaped mandrel 508 causes the rubber elements 510*a*, 510*b*, 510*c* to extend radially outward from the rubber element assembly 500 and towards the wall of the wellbore 106 or casing 118.

On deactivation, the hydraulic pump transfers hydraulic fluid from the expansion member 506 back into the hydraulic fluid reservoir. The rubber element assembly 500 can include a retraction device 522, such as a spring, to return the mandrel 508 and rubber elements 510 back into the retracted position once the hydraulic fluid has been removed from the expandable member 506. In some implementations, the hydraulic power unit 501 may be fluidly connected to a separate hydraulic power unit in another portion of the whipstock tool 200. Such a connection allows for a single hydraulic power unit to control assemblies in the event of a failure of one of the hydraulic power units, such as hydraulic power unit 501.

Figure 6:
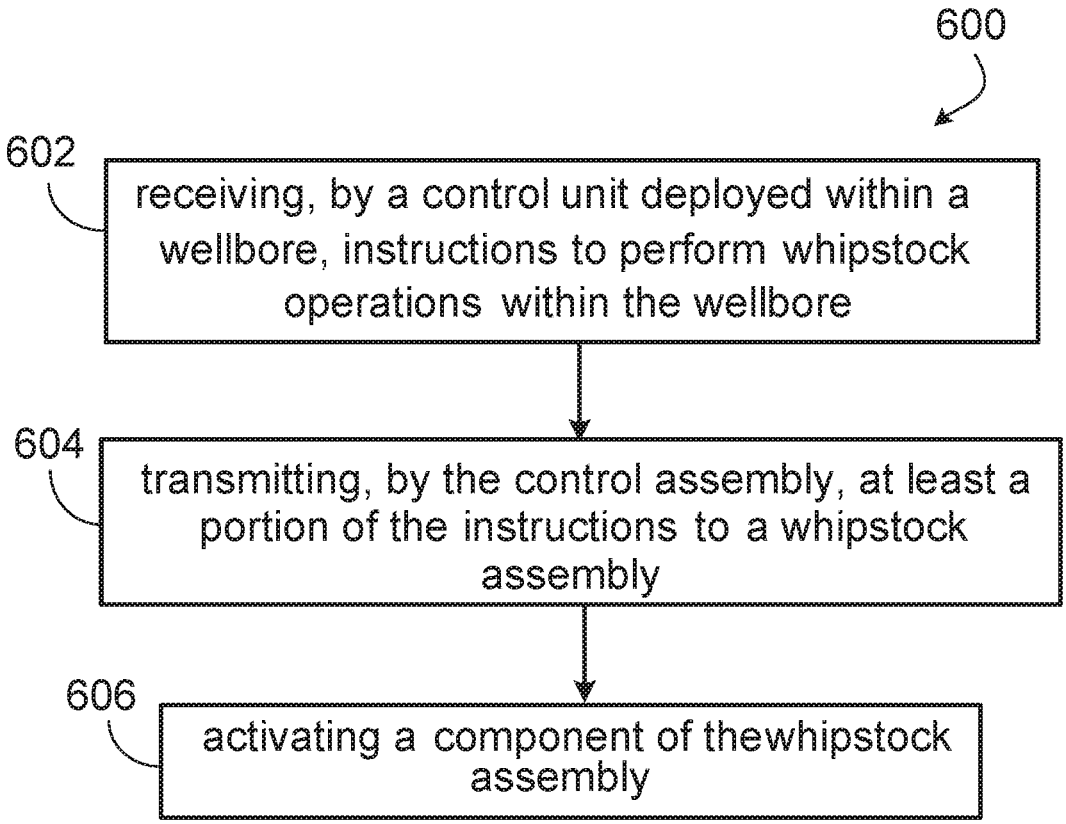
FIG. 6 is a flowchart showing an example method of controlling a whipstock tool.

FIG. 6 shows a flowchart of an example method 600 used for the wellbore drilling system 100. At 602, instructions to perform whipstock operations within the wellbore 106 are received from a surface 116 by a control assembly deployed within a wellbore 106. At 604, at least a portion of the whipstock instructions is transmitted by the control assembly to at least one component of the whipstock assembly, such as the slips 400 or the seal assembly 510. The control assembly 220 receives these instructions from the surface or the MWD sub via the receiver 304 installed in the control assembly 220. The one or more processors 306 of the control assembly 101 analyzes and identifies which HPU to be activate, HPU 310 or 314 for whipstock anchors or upper slips 206 or lower slips 208, respectively, or HPU 312 for the rubber seal assembly 210.

At 606, a respective whipstock component is activated by at least one of the HPUs 310, 312, 314 to anchor the tool within the wellbore 106. Each HPU 310, 312, 314 can be activated independently. Additionally, status signals representing a whipstock status of the at least one of the whipstock assemblies are transmitted by at least one of the whipstock assemblies to the control assembly 220. The status signals from the at least one of whipstock components is received by the control assembly 220. In some implementations the status signals from the at least one of the whipstock assemblies is transmitted to the surface 116 by the control assembly 220. The activated HPU(s) transfers hydraulic fluid from the respective reservoir(s) as described above.

At step 606, one of more of the whipstock components may be de-activated, rather than activated, by at least one of the HPUs 310, 312, 314 to release the tool or seal from within the wellbore 106. Each HPU 310, 312, 314 can be deactivated independently. Additionally, status signals representing a whipstock status of the at least one of the whipstock assemblies is transmitted by at least one of the whipstock assemblies to the control assembly 220. The status signals from the at least one of whipstock assemblies is received by the control assembly 220. In some implementations the status signals from the at least one of the whipstock assemblies is transmitted to the surface 116 by the control assembly 220. The activated HPU(s) transfers hydraulic fluid back to the respective reservoir(s) as described above.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

A number of embodiments of the invention have been described. Nevertheless, it will be understood that various modifications may be made without departing from the spirit and scope of the invention. Accordingly, other embodiments are within the scope of the following claims.

What is claimed is:

1. A whipstock system comprising:

a whipstock body;

a control unit mounted on or in the whipstock body, the control unit comprising transmitters and receivers operable to receive commands from an external source;

multiple upper slips mounted on or in the whipstock body, multiple lower slips mounted on or in the whipstock body and a hydraulic system in the whipstock body, the hydraulic system in communication with the control unit, the hydraulic system including at last one hydraulic power unit operable to repeatedly activate and de-activate the activatable components wherein the hydraulic system comprises: a reservoir and an expansion chamber in the whipstock body; and a pump in the whipstock body in fluid communication with the reservoir and the expansion chamber;

wherein transfer of fluid from the reservoir to the expansion chamber activates the multiple upper slips and the multiple lower slips;

wherein transfer of fluid from the expansion chamber to the reservoir returns the multiple upper slips and the multiple lower slips to a retracted position; and wherein the control unit comprises: one or more processors; and a computer-readable medium storing instructions executable by the one or more processors to perform operations comprising: receiving, from the external source, instructions to perform whipstock operations within the wellbore; and transmitting, to the hydraulic system, at least a portion of the instructions.

2. The whipstock system of claim 1, further comprising at least one seal assembly.

3. The whipstock system of claim 2, wherein the pump is hydraulically connected to the at least one seal assembly.

4. The whipstock system of claim 1, wherein the hydraulic power unit is operatively coupled to the one or more processors and the hydraulic power unit configured to receive at least the portion of the instructions from the one or more processors.

5. The whipstock system of claim 1, wherein the external source comprises:

one or more transmitters at the surface, the one or more transmitters configured to transmit the instructions to the one or more processors; and one or more receivers at the surface, the one or more receivers configured to receive the status signals from the one or more processors.

6. The whipstock system of claim 5, wherein the one or more transmitters and the one or more receivers are configured to communicate wirelessly with the one or more processors.

7. The whipstock system of claim 1, wherein the control unit further comprises a power source mounted on or in the whipstock body, the power source electrically coupled to the one or more processors.

8. The whipstock system of claim 7, wherein the power source is a wireless, stand-alone power source.

9. The whipstock system of claim 8, wherein the wireless, stand-alone power source is a lithium battery.

10. The whipstock system of claim 8, wherein the hydraulic system comprises a check valve.

11. A whipstock system comprising:

a whipstock body;

a control unit mounted on or in the whipstock body, the control unit comprising transmitters and receivers operable to receive commands from an external source;

multiple upper slips mounted on or in the whipstock body, multiple lower slips mounted on or in the whipstock body, and a hydraulic system in the whipstock body, the hydraulic system in communication with the control unit, the hydraulic system including at last one hydraulic power unit operable to repeatedly activate and de-activate the activatable components wherein the hydraulic system comprises: a reservoir and an expansion chamber in the whipstock body; and a pump in the whipstock body in fluid communication with the reservoir and the expansion chamber;

wherein transfer of fluid from the reservoir to the expansion chamber activates the multiple upper slips and the multiple lower slips;

wherein transfer of fluid from the expansion chamber to the reservoir returns the multiple upper slips and the multiple lower slips to a retracted position; and wherein the external source comprises: one or more transmitters at the surface, the one or more transmitters configured to transmit the instructions to the one or more processors; and one or more receivers at the surface, the one or more receivers configured to receive the status signals from the one or more processors.

12. The whipstock system of claim 11, further comprising at least one seal assembly.

13. The whipstock system of claim 11, wherein the control unit comprises: one or more processors; and a computer-readable medium storing instructions executable by the one or more processors to perform operations comprising: receiving, from the external source, instructions to perform whipstock operations within the wellbore; and transmitting, to the hydraulic system, at least a portion of the instructions.

14. The whipstock of claim 13, wherein the hydraulic power unit is operatively coupled to the one or more processors and the hydraulic power unit configured to receive at least the portion of the instructions from the one or more proessors.

15. The whipstock system of claim 13, wherein the hydraulic pump is hydraulically connected to the at least one seal assembly.

16. The whipstock system of claim 11, wherein the operations further comprise:

receiving, from the whipstock assembly, status signals representing a whipstock status of the at least one of the plurality of whipstock assembly; and transmitting, to the surface of the wellbore, the status signals.

17. The whipstock system of claim 11, wherein the one or more transmitters and the one or more receivers are configured to communicate wirelessly with the one or more processors.

18. The whipstock system of claim 13, wherein the control assembly further comprises a power source mounted on or in the whipstock body, the power source electrically coupled to the one or more processors.

19. The whipstock system of claim 18, wherein the power source is a wireless, stand-alone power source.

20. The whipstock system of claim 19, wherein the wireless, stand-alone power source is a lithium battery.

21. The whipstock system of claim 19, wherein the hydraulic system comprises a check valve.

* * * * *